United States Patent [19]

Carlson et al.

[11] Patent Number: 4,772,015

[45] Date of Patent: Sep. 20, 1988

[54] SHOULDER AND ARM EXERCISE MACHINE

[75] Inventors: Robert B. Carlson; Fredrick D. Wucherpfennig, both of Bloomington, Minn.

[73] Assignee: The Toro Company, Minneapolis, Minn.

[21] Appl. No.: 41,396

[22] Filed: Apr. 23, 1987

[51] Int. Cl.[4] ..... A63B 21/24; A63B 21/00

[52] U.S. Cl. ..... 272/116; 272/129; 272/143

[58] Field of Search ..... 272/129, 134, 70, 70.3, 272/125, 118; 128/25 R, 25 B; 280/43.24, 43.17, 43.14; 384/42, 35, 26

[56] References Cited

U.S. PATENT DOCUMENTS

| | | | |
|---|---|---|---|
| 323,792 | 8/1885 | Coop et al. | 272/118 |
| 2,446,518 | 8/1948 | Arnold et al. | 280/43.24 |
| 2,447,218 | 8/1948 | Trzesniewski | 272/123 |
| 2,777,439 | 1/1957 | Tuttle | 128/25 R |
| 2,835,539 | 5/1958 | Conrad | 384/42 |
| 3,534,974 | 10/1970 | Jerrard et al. | 280/43.24 |
| 3,537,762 | 11/1970 | Lodige | 384/42 |
| 3,859,840 | 1/1975 | Gause | 73/1 R |
| 4,084,810 | 4/1978 | Forsman | 272/73 |
| 4,101,468 | 7/1986 | Bond et al. | 272/129 X |
| 4,294,236 | 10/1981 | Hofstein | 272/DIG. 5 X |
| 4,436,303 | 3/1984 | McKillip et al. | 280/43.24 X |
| 4,625,959 | 12/1986 | Schleffendord | 272/134 X |

FOREIGN PATENT DOCUMENTS

| | | | |
|---|---|---|---|
| 1500390 | 9/1967 | France | 272/129 |
| 2045215 | 2/1971 | France | 272/79 |
| 239091 | 10/1969 | U.S.S.R. | 272/129 |

OTHER PUBLICATIONS

Loredan Biomedical leaflet entitled "The LIDO 2.0 Rehabilitation System."

Cybex booklet entitled "Isolated-Joint Testing & Exercise . . . ", pp. 7-9.

Cybex brochure entitled "You and the CYBEX II+".

Hydra-Fitness Industries leaflet entitled "The Shoulder Machine."

Tru-Trac Therapy Products Inc. leaflet entitled "AT-8252 Manual Therapy Table."

Biodex Corporation brochure entitled "One Comprehensive System for Muscle Testing and Rehabilitation" p. 6.

Biodex Corporation leaflet entitled "Comparative Features Chart."

Toro brochure entitled "Experience Weightlessness."

Toro brochure entitled "What Would Rehab and Sports Medicine be Without a Lot of Weights, Pulleys, Cables and Hydraulic Cylinders?"

Toro leaflet entitled "The Weighting is Over."

U.S. Utility application entitled "Exercise Machine," Ser. No. 675,366, filed 11/27/84.

U.S. Utility application entitled "Electronic Control of Resistance Force for Exercise Machine," Ser. No. 903,297, filed 9/2/86.

U.S. Utility application entitled "Leg Exercise Machine," Ser. No. 41,395, filed 4/23/87.

U.S. Design application entitled "Leg Exercise Machine," Ser. No. 41,578, filed 4/23/87.

U.S. Design application entitled "Shoulder and Arm Exercise Machine" Ser, No, 41,577, filed 4/23/87.

Cybex—"Isolated Joint Testing & Exercising" 272/93; 1981; pp. 1, 2, 41, 43.

*Primary Examiner*—Richard J. Apley

*Assistant Examiner*—Howard Flaxman

*Attorney, Agent, or Firm*—R. Lawrence Buckley

[57] ABSTRACT

An arm and shoulder exercise machine (20) including a base (22), a vertical rack (32) and resistance means (38) is disclosed herein. Resistance means (38) can be adjusted vertically and pivotally with respect to rack (32) using a unique rack-and-pinion system. A preferred machine (20) also includes an exercise arm (130) which carries a sliding or floating hand grip assembly (142). A preferred machine (20) further includes a pair of pivoting caster assemblies (50), each including a pair of casters (66) and a handle (54). In their raised positions, caster assemblies (50) are above feet (29); when the caster assemblies (50) are in their lowered positions casters (66) are below feet (29), thereby rendering machine (20) transportable.

4 Claims, 8 Drawing Sheets

SHOULDER AND ARM EXERCISE MACHINE

TECHNICAL FIELD

The present invention relates generally to machines for exercising, testing and rehabilitating various muscle groups of the body. More specifically the invention pertains to machines for exercising the shoulder and elbow.

BACKGROUND OF THE INVENTION

Exercise machines of various types are well known. One way to categorize exercise machines is based on the particular muscle group, limb or joint being exercised. As is well known, there are multistation machines which are capable of exercising several different muscle groups. An example of this type of machine is the Isopower 5000 machine sold by The Toro Company Minneapolis, Minn., the assignee herein. The Isopower 5000 multistation exercise machine includes a pair of magnetic particle brakes which are freely adjustable along a pair of arcuate support bars, and are also angularly adjustable with respect to the support bars. Such a machine can provide a wide variety of exercises, including leg extension/curl; chest press; pullover; hip-back/abdominal flex; shoulder press/lat pull-down; declined chest press/rowing; biceps curl/triceps extension; chest cross/rowing; and hip adduction/abduction.

There are also single station exercise machines which are specifically designed to exercise a single joint or muscle group. The present invention is particularly directed to a shoulder and elbow single station machine. However, those skilled in the art will recognize that the elbow and shoulder machine of the present invention could be incorporated into a multistation machine as well. It should also be noted that the preferred shoulder and elbow machine of the present invention can be used for general exercise and also for rehabilitation therapy under the guidance of a trained physical therapist.

As noted above, a preferred embodiment of the present invention is a single-station shoulder and elbow exercise machine. Although the desirable structural and functional features of shoulder and elbow exercise machines may varY depending on the application, i.e., light duty exercise, heavy duty exercise, or therapy, certain desirable features for all types of shoulder/elbow machines can be identified. Of course, a shoulder-/elbow exercise machine must be capable of exercising a wide variety of shoulder and elbow movements. While it is fairly easy to exercise the elbow joint, since the elbow provides a simple hinging between the upper and lower arm portions, the shoulder is an extremely complex structure whose multiple articulations result in a range of motion which exceeds that of any other joint, and places unique requirements on a shoulder/elbow exercise machine. Given the complexity ot the shoulder joint, a shoulder and elbow machine should preferably accommodate a wide variety of exercises, including all extension/flexion, abduction/ adduction and internal-/external rotation motions of the elbow and shoulder complex.

Arm and shoulder exercise machines should preferably be adjustable. Exercise machines have "resistance units" which are traditionally hydraulic, pneumatic or simply mechanical (e.g., weight stack), as in the case of Nautilus machines and the like. Coupled in some manner to the "resistance unit" is an "exercise arm," the free end of which is grasped by the user and pivoted or translated in accordance with the prescribed exercise. The resistance unit is preferably vertically adjustable to accommodate different table or chair heights user sizes and positions and exercises. In addition, the resistance unit or the entire exercise machine should be angularly adjustable, in a vertical plane, for various orthogonal and diagonal exercises. For dynamometer resistance units that include an armature the axis of the dynamometer's armature must be adjustable so that it is colinear with the assumed axis of rotation of the joint.

Not only should shoulder/elbow machines be adjustable, they should also provide a wide range of motion. Any machine designed to exercise the shoulder must accommodate the natural movement of the joint, for exercise should increase flexibility as well as strength. Movement of the shoulder, in particular, results in a changing user "lever arm". Thus, Applicants perceive that the free end of the exercise arm should carry a "floating" or sliding cuff or grip so that the user's natural motion is not hindered by the exercise arm, but instead the exercise machine itself can dynamically realign itself to the natural joint motion. Applicants have found that a floating hand grip allows for a more accurate torque transfer throughout the range of motion and increases patient comfort through reduced joint stress.

Shoulder/elbow exercise machines, in addition to accommodating various natural shoulder and elbow movements, should preferably be portable. It is desirable to have a plurality of therapy tables or beds and only one comparatively expensive piece of shoulder/elbow rehabilitation equipment which can be readily moved from user to user. It should be very easy to convert the exercise machine from the stationary to the mobile mode. And, the mechanism for providing mobility to the exercise machine should be very simple easy to maintain, and not contribute significantly to the cost of the machine. Finally, the exercise machine should be lightweight, well balanced and maneuverable.

Exercise and rehabilitation devices typically include casters or wheels for portability. The casters are lockable or, alternatively, a set of auxiliary legs can be lowered to in effect raise the casters off the floor surface to render the equipment nonrollable. Locking casters are useful in some circumstances, but they are inconvenient since each caster must be individually locked. Further, since only a very small portion of each caster touches the floor the traction provided by locked casters is oftentimes inadequate. Thus, it is perceived that the latter method, i.e., providing a set of auxiliary legs which can be lowered in relation to the casters to provide a stable base, is superior.

Such machines should be stable once transported and adjusted. Shoulder/elbow machines should be capable of providing up to approximately 80 foot-pounds of torque. The machine must not be susceptible to swaying, tipping or sliding, for otherwise the machine will be difficult to use.

Although prior art multipurpose exercise machines are generally useful for their intended purposes including shoulder and elbow exercises they do not include all of the desirable features discussed above. For example the Cybex II machine sold by Cybex, Division of Lumex, Inc., Ronkonkoma N.Y., includes a fixed lever arm i.e. a hand grip or cuff which is fixed to the exercise arm. This fixed lever arm system provides an accurate indication of the force being applied by the user, by measuring the torque at the pivoting end of the dynamometer but tends to restrict the natural motion of the joint since the pivot point of the shoulder changes throughout a motion. The Cybex system also includes a dynamometer which is indeed portable but is unstable and must be clamped to a rather massive and expensive wooden table. In order to use the Cybex dynamometer for elbow and shoulder exercising, the user sits or lays on an expensive therapy table and the user, not the exercise machine, is adjusted depending on the prescribed exercise. Thus, the exercise machine itself cannot be wheeled to a standard bed or chair, but instead must be rigidly clamped to a massive support structure. The Cybex dynamometer cannot be adjusted once it is clamped in place.

Further, the Cybex "UBXT" therapy table which is sold in conjunction with the Cybex dynamometer has a very complex leg support system which includes four casters and four auxiliary legs, wherein the auxiliary legs can be raised or lowered relative to the casters to render the machine mobile or stationary. The means for moving the auxiliary legs includes a complex rod and pivot linkage between a pair of foot pedals and the legs, and the whole mechanism is connected to a shock absorber which is apparently incorporated to control the rate of movement of the auxiliary legs relative to the rest of the therapy table. It is perceived that this auxiliary leg system makes for a cumbersome and complicated table which is quite expensive, heavy and mechanically complex; and that it would be better to use a stationary therapy table in conjunction with a portable and adjustable exercise/therapy device.

Another prior art exercise system commonly used for shoulder/elbow exercise is sold by the Biodex Corporation. While the Biodex machine includes a "floating" hand grip, it is perceived that the grip sliding mechanism is too flimsy for relatively heavy exercising. Also, the Biodex machine like the Cybex machine, is disadvantageous because the resistance unit itself is not portable but is instead connected to a massive support structure. Thus, it is impossible to wheel the resistance unit from one location to another without either moving the rather large and expensive support structure, or having multiple support structures.

While the prior art multipurpose exercise machines discussed above are generally effective for their intended purposes, including shoulder and elbow exercises it is perceived that they have numerous shortcomings. The present invention addresses these problems. In particular, a preferred shoulder/elbow machine according to the invention includes a "floating" hand grip sturdily mounted on an exercise arm; and is a fully adjustable, portable and stable exercise machine suitable for use with any type of therapy table or any type of bed or chair. Preferred machines according to the invention include a simple, lightweight and compact means for selectively engaging casters with the floor surface. Other advantages and features of the present invention are described below.

SUMMARY OF THE INVENTION

Accordingly, one aspect of the present invention is directed toward an exercise apparatus having a simple means for changing an exercise apparatus from its stationary mode to its mobile mode, and vice versa. In particular, one embodiment of an exercise apparatus according to the invention includes:

(a) a base comprising a plurality of depending feet;

(b) a plurality of caster assemblies operatively connected to the base, each caster assembly comprising:
  (i) a lift frame pivotally connected to the base; and
  (ii) a caster pivotally connected to the lift frame, each lift frame having a raised position wherein the associated caster is above the associated feet and a lowered position wherein the associated caster is below the associated feet;

(c) a resistance unit operatively connected to the base; and (d) means for selectively locking the lift frames to the base in their lowered positions, whereby when the lift frames are locked in their lowered positions the exercise apparatus is mobie, and when the lift frames are in their raised positions the exercise apparatus is stationary.

Preferably, the exercise apparatus includes a pair of caster assemblies and each lift frame carries a pair of casters. Further, each lift frame preferably forms an upwardly-extending handle, whereby the exercise apparatus can be changed from its mobile state to its stationary state, and back again, by manipulating the handles and "locking means."

The "locking means" preferably includes a plurality of spring-loaded pins operatively connected to the base, one each of the spring-loaded pins being selectively engageable with one each of the lift frames.

A preferred exercise apparatus according to the invention also includes means for vertically and pivotally adjusting the resistance means relative to a rack which extends vertically from the base of the exercise apparatus. A friction pin can be included to frictionally engage the rack once it is placed in its selected vertical position. Also the exercise apparatus can include a pair of yokes which extend from the vertical rack and pivotally support an electromagnetic brake. Thus a preferred apparatus according to the invention is readily portable and can be adjusted to accommodate a wide variety of orthogonal and oblique exercises.

To prevent shoulder compression, a preferred arm and shoulder exercise apparatus according to the invention includes a floating grip assembly, wherein a hand grip support is separated from the exercise arm by a plurality of spaced slides, whereby the slides provide a low friction interface between the hand grip assembly and the exercise arm.

Finally, a preferred exercise arm according to the invention includes a removable elbow support extending from the resistance means suitable for preventing relative motion between the exercising individual's elbow and shoulder, particularly useful for shoulder rotation exercises.

Additional features and aspects of the invention are described below in connection with the Drawings.

BRIEF DESCRIPTION OF THE DRAWINGS

The invention will be further described with reference to the Drawings wherein.

DETAILED DESCRIPTION OF PREFERRED EMBODIMENTS

Figure 1:
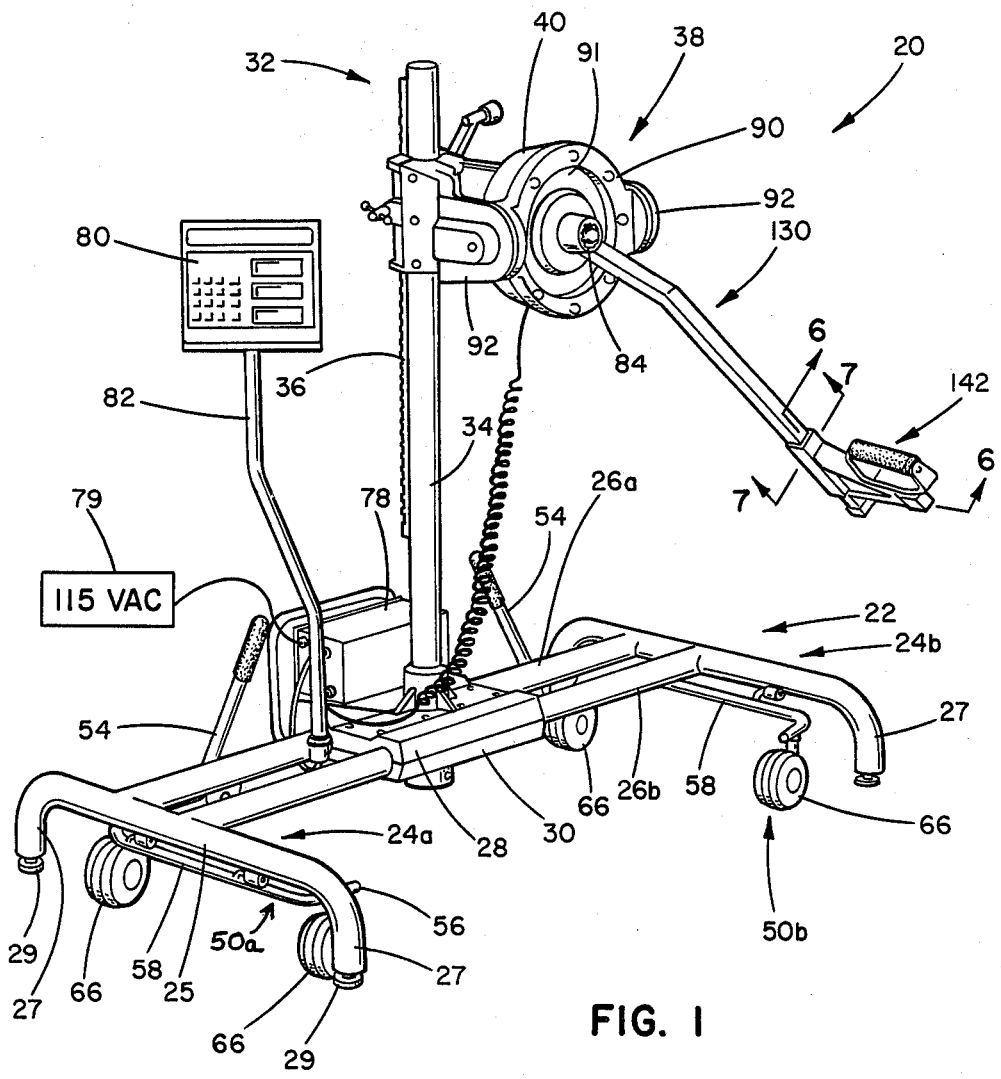
FIG. 1 is a perspective view of a shoulder and arm exercise machine according to the invention.

Referring to the drawings. wherein like reference numerals designate like parts and assemblies throughout the several views, FIG. 1 illustrates a shoulder and elbow exercise machine 20 according to the invention. Exercise machine 20 includes a tubular base 22 having a pair of inverted U-shaped end members 24*a* and 24*b* spanned by a pair of parallel horizontal cross members 26*a* and 26*b* welded thereto. Each U-shaped end member 24 includes a horizontal top portion 25 and a pair of comparatively short vertical end portions 27. Each end portion 27 terminates at its lowermost end with an adjustable glide 29 suitable for leveling machine 20 when it is in its stationary mode.

A substantially planar cast metal top clamp 28 and a similar cast metal bottom clamp 30 sandwich the cross members 26 and are bolted together using conventional threaded fasteners. It should be noted that each cross members 26 can be a single piece of round tubular steel, or can alternatively be a pair of axially-aligned tubes which are in effect coupled together within the cavity formed by top and bottom clamps 28 and 30.

Top and bottom clamps 28 and 30 include central vertically-aligned bosses which receive a vertical rack 32. Rack 32 consists of (i) a chromed steel tube 34 which is engaged by a pair of threaded fasteners which also engage the bosses on the top and bottom clamps 28 and 30; and (ii) a toothed bar 36 attached to the rear side of chromed steel tube 34 and running substantially along its entire length. Rack 32 carries a means 38 for providing resistance to shoulder and elbow exercise. Resistance means 38 includes an electrically-operated brake 40 which is longitudinally moveable on rack 32, by virtue of toothed bar 36, and also vertically pivots with respect to rack 32 so that the working axis of brake 40 can be shifted between different orientations to accommodate exercising movements which require the shoulder and elbow joints to pivot in different planes. The structure and function of resistance means 38 are further described below.

CASTER ASSEMBLIES

Figure 4:
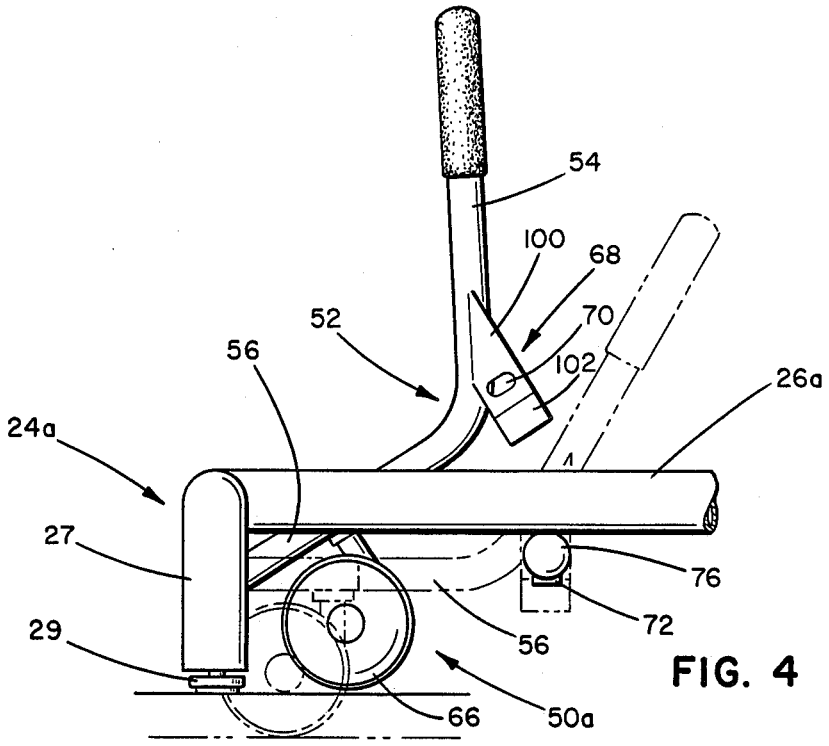
FIG. 4 is a front elevational view of a portion of the exercise machine of FIG. 1, showing on of the caster assemblies in the raised position, in solid line, and in the lowered position. in phantom.
Figure 5:
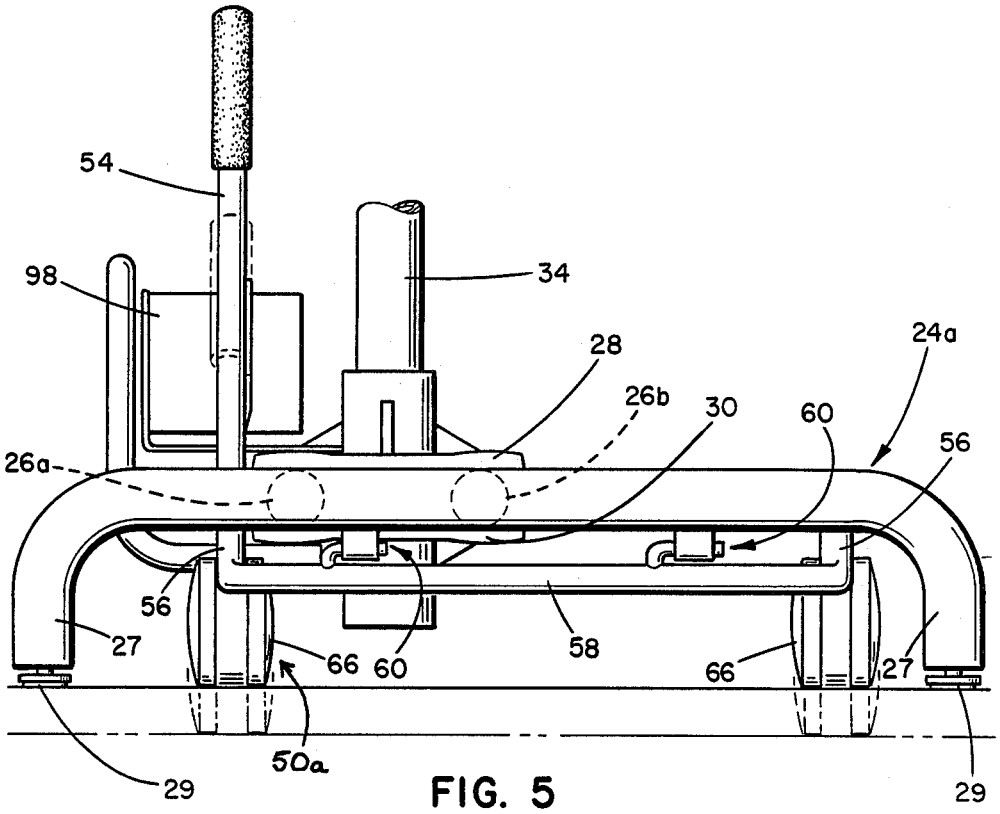
FIG. 5 is an end elevational view showing one of the caster assemblies in its raised position in solid line, and in its lowered position in phantom.

Exercise machine 20 preferably includes a pair of caster assemblies 50*a* and 50*b* operatively connected to base 22 suitable for assisting in the selective transportation of the exercise machine 20 from place to place. That is, caster assemblies 50*a* and 50*b* can be used to switch machine 20 from a "stationary mode" to a "mobile mode" and vice versa. FIG. 4 shows a front elevational view of caster assembly 50*a* and FIG. 5 shows an end elevational view of same; caster assembly 50*b* is a mirror image of assembly 50*a*. Each caster assembly 50 comprises a tubular steel lift frame 52 having an upwardly-extending lift handle 54; a pair of spaced caster-supporting elements 56; and a transverse portion 58 spanning between the caster-supporting elements 56. Preferably, lift frame 52 consists of a single piece of appropriately bent round steel tubing. As shown in FIGS. 4 and 5, lift handle 54 extends upwardly from the left caster-supporting element 56 (as viewed in FIG. 5). The transverse portion 58 of lift frame 52 is substantially parallel to the horizontal top portion 25 of end member 24. And, when machine 20 is in its "mobile mode," caster-supporting elements 56 are substantially parallel to cross member 26 of base 22.

Referring to FIG. 5, each lift frame 52 is pivotally attached to the associated end member 24 by means of a pair of bushing assemblies 60. Each bushing assembly 60 includes an L-shaped rod welded to and extending upwardly from transverse portion 58 of lift frame 52, wherein the long leg of the "L" is substantially parallel to the longitudinal axis of the tubular transverse portion 58, and the short leg of the "L" is substantially perpendicular thereto. The "L" long legs are received by bushings which are fixedly attached beneath base top portions 25. Thus, lift frames 52 can pivot relative to base 22.

Each caster-supporting element 56 of lift frames 52 receives a caster 66 which can horizontally pivot relative to its caster-supporting element 56 in familiar fashion. Thus it can be seen, referring to FIG. 4, that clockwise rotation of handle 54 causes the associated casters 66 to lower; and counterclockwise rotation of handle 54 raises the casters 66 relative to base 22.

Extending downwardly from each handle 54 is a bracket 68 which forms a slotted aperture 70. Bracket 68 consists of a substantially vertical portion 100 adjacent handle 54, and an oblique portion 102 which angles away from cross members 26. Aperture 70 is formed in the vertical portion 100. The function of bracket 68 is discussed below.

Extending downwardly from either end of the rearmost cross member 26*a* is an apertured upwardly pointing U-shaped pin bracket 72. pin bracket 72 is suitable for slideably receiving a spring-loaded pin 74. Spring-loaded pin 74 is spring biased to the left (as viewed in FIG. 5) toward the associated apertured bracket 68.

Spring-loaded pin 74 is situated horizontally and includes a handle portion 76 which is graspable to draw the pin 74 to the right, as shown in FIG. 5. The oblique end 102 of bracket 68 angles away from spring-loaded pin 74 so that when frame 52 is pivoted clockwise, as viewed in FIG. 4 the obligue portion 102 of bracket 68 urges pin 74 against the spring pressure to the right, as viewed in FIG. 5, and eventually allows pin 74 to enter aperture 70, thereby locking lift frame 52 against further rotation in either direction. To allow frame 52 to rotate in a counterclockwise direction, as viewed in FIG. 4, it is necessary to withdraw pin 74 against spring pressure out of aperture 70. Therefore, if casters 66 are in their lowered positions, as shown in phantom line in FIGS. 4 and 5, such that glides 29 are above casters 66 and machine 20 is in its mobile mode, casters 66 can be raised by withdrawing spring-loaded pins 74 out of apertures 70 and simply allowing the weight of machine 20 to push upward on casters 66 to rotate frames 52 upwardly.

If the casters 66 are in their raised positions, as shown in solid line in FIGS. 4 and 5, and it is necessary to lower them to change machine 20 from its "stationary mode" to its "mobile mode," it is simply necessary to grasp handle 54 and rotate frame 52 in a clockwise direction, as shown in FIG. 4. When the lower oblique portion 102 of bracket 68 engages spring-loaded pin 74, pin 74 will move against the spring pressure onto the upper vertical surface 100 of bracket 68 and ultimately into aperture 70 to lock frame 52 relative to base 22. Each caster assembly 50 operates in identical fashion, but they must be rotated in opposite directions inasmuch as they are mirror images of one another. Therefore, it is clear that machine 20 can be quickly converted from its "stationary mode" to its "mobile mode," or vise versa, by simple manipulation of handles 54 and/or spring-loaded pins 74.

RESISTANCE MEANS

As noted above, machine 20 includes resistance means 38 which includes an electromagnetic brake 40 Although a wide variety of electromagnetic brakes could be used, a preferred brake is a 24 VDC 1.7 amp magnetic particle brake manufactured by Shinko Electric Company, Ltd., Japan, under the designation PRB-10A. Brake 40 includes a generally circular case 91 that has an output shaft 84 projecting from one side thereof. Output shaft 84 forms part of or is connected to the armature of brake 40 with the armature being surrounded in a known manner by electrical stator windings (not shown). When electricity is supplied to the windings, a magnetic field is generated which resists rotation of the armature. Thus, rotation of output shaft 84 will be resisted by a variable force that is directly dependent upon the current supplied to the windings. The greater the amount of current, the greater the resistance to rotation, i.e. the greater the force against which the user exercises. The stator windings of brake 40 are electrically coupled to a controllable DC power supply 78 which in turn is connected to a standard 115 VAC power source 79. power transistors within DC power supply 78 are modulated by a controller 80 mounted on a mast 82 Which extends upwardly from the rearmost cross members 26. Controller 80 includes a microcomputer which is programmed by means of pushbuttons or keypads on its face, and controller 80 preferably includes several digital displays which conveniently show the number of repetitions of the exercise cycle per minute, total number of repetitions per session, rate of energy expended per hour and the cumulative energy expended during the session. The power transistors (not shown) within power supply 78 are controlled by controller 80 to apply 0 to 24 volts DC and 0 to 1½ amps DC to the stator windings of brake 40.

Operation of controller 80 in conjunction with power supply 78 and brake 40 is discussed in detail in U.S. patent application Nos. 903,297 filed Sept. 2, 1986; and 675,366 filed Nov. 27, 1984, incorporated herein by reference. Briefly controller 80 is provided to allow the user to set the effort level or force provided by brake 40 depending upon the configuration of the apparatus and the particular exercise being performed, and the overall conditioning level of the user. Electronic control system 80 permits the user to set a first torque setting for one direction of movement of the brake shaft 84, corresponding to a first half-cycle of the exercise, and a second torque setting for the return movement or second half-cycle. This allows the user to set or "tailor" the force levels in each half-cycle to the strength of the muscle group being exercised in that particular half-cycle. Thus, the force levels in the second half-cycle could be higher or lower than the force levels in the first half-cycle. And, as noted above controller 80 monitors operation and provides the user with convenient displays of repetitions of the exercise cycle per minute, and so on. If a specific range of motion is desired, this may be set by positioning the arm at one desired limit, pressing a "limit range" key pressing a "set range" key, and moving the arm through a "rep" or cycle. Then, as the exercise arm 130 is raised and lowered a beeper within controller 80 will sound when each limit is reached. This "soft" range of motion limit is described U.S. patent application No. 903.297. filed Sept. 2, 1986, incorporated herein by reference.

Figure 3:
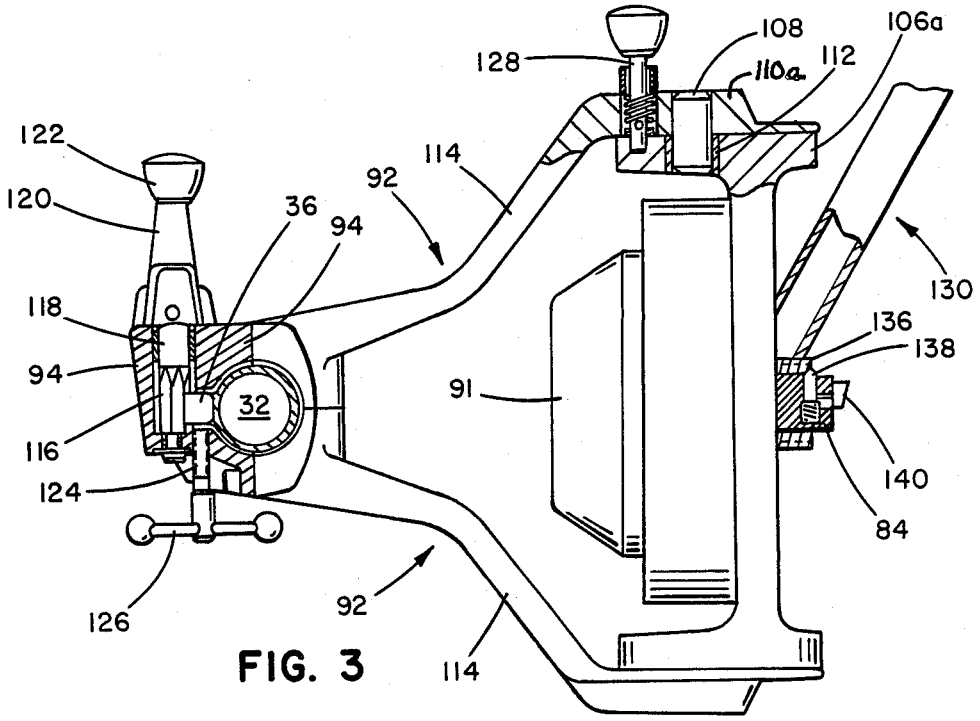
FIG. 3 is a partially sectioned top plan view of the resistance unit of the exercise machine of FIG. 1.

Circular case 91 of brake 40 is bolted to a cast metal ring-like brake mount 90 which pivotally spans between a pair of yokes 92 which in turn slideably clamp around rack 32. Brake mount 90 includes an annular central portion 104 which is apertured around its periphery at regular angular intervals to receive threaded fasteners which also engage the circular periphery of case 91. At either end of the annular portion of mount 90 is a flat 106 which is perpendicular to the annular portion and forms a hole suitable for receiving a pivot pin 108. The flats 106 at either end of the annular portion 104 are parallel and the pin-receiving holes in the flats are axially-aligned Each yoke 92 also forms a flat 110, wherein the yoke flats slideably engage the ring mount flats 106 as shown in FIG. 3. pins 108 are held within the yoke holes using set screws (not shown); bushings 112 are press fit into brake mount 90; and pins 108 slide within bushings 112. Brake 40 can thereby pivot such that the axis of shaft 84 moves in a vertical plane passing through the centerline of rack 32.

As noted above, each yoke 92 includes a flat portion 110 at its forward end suitable for pivotally engaging brake mount 90. Extending rearwardly from each flat portion 110 is a substantially L-shaped portion 114. The two L-shaped portions 114 converge toward and surround the frontmost half of chromed steel tube 34. The back portion of tube 34 and toothed bar 36 are encased by a curved cap 94 which connects to the front yokes 92 using a plurality of standard threaded connectors. Yokes 92 and cap 94 combine to form a round aperture which receives a pair of split nylon bushings (not shown) which slide on chromed tube 34. It should be noted that the parts comprising yokes 92 and cap 94 could be a single integral part. Sufficient clearance or a pair of low friction bushings between the yokes 92 and cap 94 and rack 32 is used to insure smooth, non-binding vertical movement of the entire resistance means assembly 38.

VERTICAL ADJUSTMENT OF RESISTANCE MEANS

As noted above, toothed bar 36 extends rearwardly from chromed tube 34. The gear teeth of toothed bar 36 face to the outside of the bar. As shown in FIG. 3, cap 94 forms an aperture which contains a rotatable pinion 116 that is engaged with toothed bar 36, thereby forming a rack and pinion connection between rack 32 and resistance unit 38. Pinion 116 is mounted or keyed to the end of a shaft 118 which extends outwardly through cap 94 to be coupled by a roll pin to the end of a rotary handle 120. A rotatable ball 122 on the free end of handle 120 can be gripped to turn the handle. When handle 120 is rotated, pinion 116 will rotate in engagement with toothed bar 36 to cause resistance means 38 to move up and down along the length of rack 32. This rack and pinion also helps support the weight of resistance means 38 and eases the task of moving it up and down rack 32.

There are two separate locking means, i.e. a main lock and a secondary lock, for locking resistance means 38 in position on rack 32. The main lock is illustrated in FIG. 3 and comprises a friction pin 124 which is threadedly received by an aperture in cap 94 on the opposite side from handle 120. Friction pin 124 is suited to bear against the side of toothed bar 36 and spans across a number of the gear teeth. At the outer end of friction pin 124 is a handle 126 which can be gripped by the user of machine 20. When handle 126 is turned in the appropriate direction friction pin 124 is forced into engagement with the outside of toothed bar 36 to lock resistance means 38 on rack 32. This main lock is desirably used whenever the brake 40 is in use as an exercise device since it has more holding power than the secondary lock now to be described.

When it is desired to move resistance means 38 from one position to another, the main lock defined by friction pin 124 must first be released. However, if the user is not at the same time holding onto handle 120 Applicants have found that the weight of resistance means 38 will tend to move entire resistance means 38 downward. Thus, a spring-loaded detent ball (not shown) is mounted within cap 94. A recess in handle 120 periodically engages the detent ball as it rotates so as to control the free movement of handle 120 in the event that the main lock is released without grasping resistance means 38 or handle 120.

PIVOTAL ADJUSTMENT OF RESISTANCE MEANS

Figure 2:
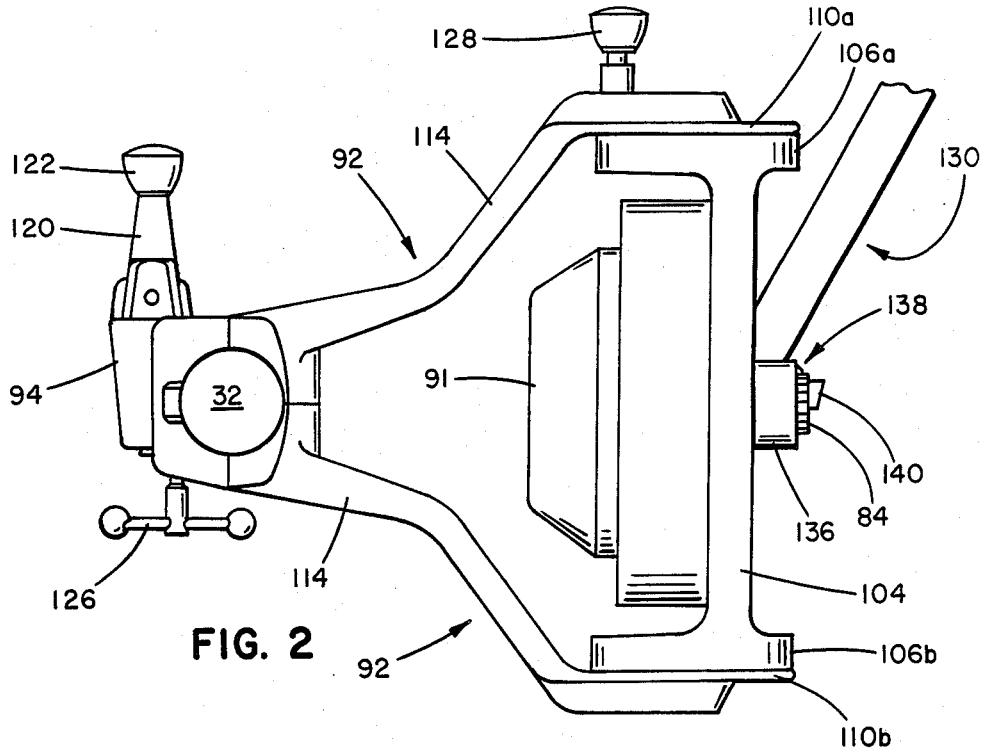
FIG. 2 is a top plan view of the resistance unit of the exercise machine of FIG. 1.

Brake 40, in addition to being longitudinally or vertically moveable, is also pivotal relative to yokes 92. Brake mount flat **106*a* (the top flat 106 as viewed in FIGS. 2 and 3) forms a plurality of apertures circumferencially spaced about the aperture which receives pivot pin 108. A spring-loaded pin 128 mounted in the corresponding yoke flat 110*a* is urged toward these spaced apertures, and when received by one of the apertures, locks brake 40 in the selected position relative to yokes 92. Brake 40 has a first position in which it is generally vertical, with output shaft 84 being generally horizontal as shown in FIG. 1. However, when it is desired to pivot brake 40 either to its horizontal position (shaft 84 in the vertical position) or to some intermediate oblique position, spring-loaded pin 128 is first pulled outwardly and thereby disengaged from brake mount flat 106*a*. Brake mount 90 is then rotated about pivot pins 108 until it reaches the selected position. Pin 128 is then released, to engage the selected aperture in brake mount flat 106*a***.

EXERCISE ARMS

As shown in the Drawings, a variety of exercise arms can be attached to brake output shaft 84 extending from the armature of brake 40, depending on the desired exercise. FIGS. 1 and 8–10 show an exercise arm 130 suitable for use in shoulder abduction/adduction and extension/flexion exercises. These exercises are further discussed below. Another type of exercise arm 132 is shown in use in FIGS. 11–14. Arm 132 can be used by itself for elbow extension/flexion exercises, or an elbow stabilizer 134 can be added to maintain the position of the elbow relative to the shoulder for various shoulder rotation exercises, as further described below. Elbow stabilizer 134 includes a round tubular portion 135 which is notched at one end to receive the square tubing of exercise arms 130, 132. The other end of tubulat portion 135 supports a substantially U-shaped sheet metal pad support 137 which in turn carries a pair of elbow pads 139. As shown in FIG. 12, the exercising individual wedges his or her elbow between pads 139 and relative motion between the shoulder and elbow is thereby precluded.

Arms 130, 132 attach to brake shaft 84 using a quick-release technique. Shaft 84 is externally splined to receive an internally splined collar 136 included on each of the exercise arms 130, 132. The mating splines allow resistance torques to be transmitted between brake 40 through arm 130, 132 and ultimately to the exercising individual. Also. referring to FIG. 3 brake shaft 84 is radially apertured to receive a locking pin 138 and is axially apertured to receive a roll pin which extends between lock pin 138 and a quick disconnect knob 140 mounted on the far axial end of brake shaft 84. A compression spring within brake shaft 84 urges lock pin 138 radially outward so that the outer radial end of lock pin 138 extends into the trough between a pair of adjacent splines on the brake shaft 84. To attach an exercise arm 130, 132, one simply pushes exercise arm collar 136 over brake shaft 84. Collar 136 engages an inclined surface on the front edge of pin 138 and pushes pin 138 into shaft 84. Once collar 136 is in position, the compression spring within shaft 84 forces pin 138 outward so that it bears on the outer edge of collar 136 to prevent exercise arm 130, 132 from inadvertently disattaching itself from shaft 84. To remove exercise arm 130, 132 from brake shaft 84, it is necessary to push knob 140 radially inward toward the centerline of shaft 84. This causes lock pin 138 to recede within shaft 84 and permits collar 136 to freely slide over the end of shaft 84.

Floating Hand Grip

As noted above, exercise arm 130 preferably includes a floating hand grip assembly 142 which freely floats or slides relative to exercise arm 130. Use of floating hand grip assembly 142 permits the shoulder to move naturally, since the shoulder joint does not have a single pivot, but instead the virtual pivot of the shoulder moves during any given shoulder motion. If the grip assembly 142 were fixed to the exercise arm this could result in potentially harmful compression of the shoulder joint structure.

Figure 7:
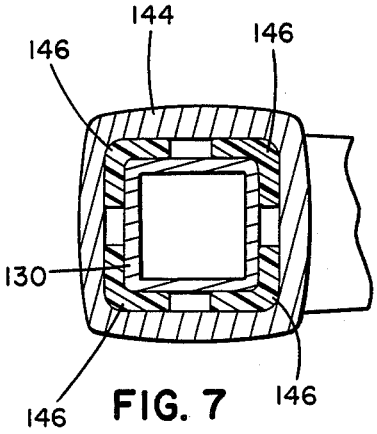
FIG. 7 is a transverse sectional view of a portion of the hand grip assembly of the exercise machine of FIG. 1, taken substantially along line 7—7 of FIG. 1.
Figure 6:
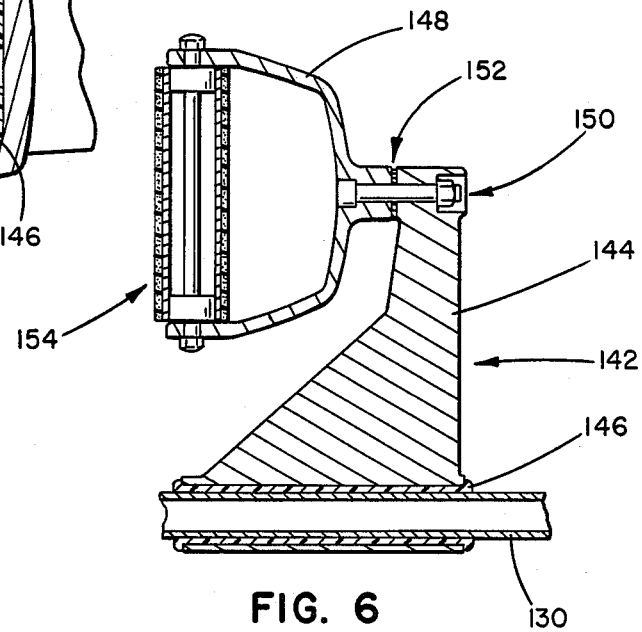
FIG. 6 is a longitudinal sectional view of one of the hand grip assemblies of the exercise machine of FIG. 1, taken substantially along line 6—6 of FIG. 1.

A longitudinal cross section of floating hand grip assembly 142 is shown in FIG. 6. Assembly 142 includes a cast metal support 144 which at one end forms a square aperture slideably receiving the sguare tubing of exercise arm 130. Four L-shaped support slides 146 (shown in FIG. 7), preferably made of polyethylene or the like, separate the metal support 144 from the metal exercise arm 130 so as to reduce the frictional contact therebetween. A transverse sectional view of slides 146, exercise arm 130 and support 144 is shown in FIG. 7. As illustrated, support slides 146 do not completely surround arm 130, there being spaces between adjacent L-shaped slides 146.

The square apertured end of support 144 which receives arm 130 is preferably approximately 6 inches long. It has been found that by making the square apertured portion this long, and by using polyethylene slides 146, floating hand grip assembly 142 smoothly slides on arm 130 irrespective of the nature or magnitude of the forces on 142. That is, assembly 142 does not tend to bind on arm 130 even when subjected to extensive twisting and bending moments.

Support 144 carries, at its other end, a substantially U-shaped grip yoke 148. A standard threaded fastener 150 interconnects support 144 and grip yoke 148, and a polyethylene washer 152 separates yoke 148 from support 144 and creates a low friction interface therebetween, thereby allowing grip yoke 148 to rotate on fastener 150 relative to support 144. Spanning the forks or legs of grip yoke 148 is a hand grip 154 which is preferably rotatable relative to yoke 148 and is coated with a resilient material which can be comfortably grasped by the user.

Referring to FIGS. 11–14, arm 132 carries a grip assembly 156 which is similar in some respects to grip assembly 142. Grip assembly 156 includes a T-shaped support 158 which is preferably made of cast metal and is separated from the sguare tubing of exercise arm 132 through the use of four L-shaped support slides identical to support slides 146 described above. Support 158 carries on one side a resilient grip 160 which can rotate relative to the square apertured portion which surrounds tube 132; and on the other side carries a threaded friction pin 162 which, when appropriately rotated, frictionally bears against arm 132 to lock assembly 156 onto arm 132. Thus, when it is necessary to adjust the effective length of arm 132 it is simply necessary to loosen friction pin 162 and slide assembly 156 relative to arm 132 to the desired position, and then retighten friction pin 162. Those skilled in the art will recognize that it is not necessary or desirable to allow grip assembly 156 to "float" during actual use, since the distance between the elbow and the hand of a user (see FIG. 11 for example) should not vary during shoulder rotation exercises. While shoulder joint compression could occur during shoulder abduction/adduction and extension/flexion exercises if a non-sliding hand grip were used, there is no danger of compressing the elbow joint by fixing the grip assembly 156 relative to arm 132.

SUMMARY OF OPERATION

Although exercise machine 20 has been described in some detail above, and most if not all of the functional aspects of the machine have also been discussed the operation of machine 2o is summarized below.

The first step is to decide what type of exercise is to be performed. Once this decision is made machine 20 can easily be located adjacent the patient table or chair so that the patient may perform the desired exercise. As discussed above, machine 20 is placed in its "mobile mode" by simply lowering caster assemblies 50 relative to frame 22 by manipulating handles 54. Caster assemblies 50 are locked in their lowered positions when spring-loaded pins 74 engage apertures 70 in brackets 68 extending downward from handles 54. Once machine 20 is maneuvered into position, it is secured in place by withdrawing pins 74 from corresponding apertures 70 and allowing the weight of machine 20 to force caster assemblies 50 upward, thereby allowing glides 29 to contact the floor surface to provide a stable base for resistance unit 38. If necessary, glides 29 can be adjusted to level machine 20 by rotating them relative to elements 27 which threadedly receive glides 29.

Once machine 20 is in position and secured, power supply 78 should be connected to a standard 115 volt AC grounded outlet. Upon doing so and after pressing an appropriate power switch mounted on power supply 78, digital displays on the face of control module 80 will activate.

Resistance unit 38 is then vertically and pivotally adjusted in accordance with the exercise to be performed. As noted above EMR unit 38 can be vertically adjusted by rotating handle 126 to withdraw friction pin 124 away from toothed bar 36. Then by grasping ball 122 and rotating handle 120, pinion 116 rotates relative to toothed bar 36 and causes resistance unit 38 to traverse up or down along rack 32. Split nylon bushings between yokes 92 and cap 94 allow resistance unit 38 to easily slide up and down chromed tube 34. Once resistance unit 38 is appropriately vertically positioned, handle 126 is manipulated to cause friction pin 124 to once again frictionally engage toothed bar 36, thus locking resistance unit 38 against further vertical movement relative to rack 32.

Resistance unit 38 can also be pivotally adjusted by withdrawing spring-loaded pin 128 from one of the holes in flat **106*a* and rotating brake case 91 relative to yokes 92, and finally releasing pin 12 to allow it to engage another of the apertures in brake mount flat 106*a*. As noted above, there are several apertures in brake mount flat 106*a***, so as to accommodate all of the standard orthogonal exercises and, in addition, many oblique or diagonal motions.

Once resistance unit 38 is vertically and pivotally adjusted, either arm 130 or 132 can be attached simply by sliding splined collar 136 of the chosen exercise arm 130, 132 over the externally-splined brake shaft 84. When collar 136 is in the proper position, spring-loaded lock pin 138 prevents collar 136 from being removed from shaft 84 until quick disconnect knob 140 is appropriately engaged.

The patient or user should then be appropriately stabilized on the chair or table using straps as necessary. The elbow stabilizer 134 should be used in conjunction with exercise arm 132 for internal/external shoulder rotation exercises.

Following the mechanical setup, it is necessary to select the desired clockwise and counterclockwise torque by activating switches or key pads on the face of controller 80. Of course, controller 80 could be desiqned or preprogrammed so as to apply certain default resistances or torques in the event that no resistances are affirmatively selected.

Finally, if a specific range of motion is desired, "soft" (audible) stops may be established using the process described above. Then as the exercise arm 130, 132 is rotated in one direction and then the other, a beeper will sound when each end of motion is achieved.

Figure 8:
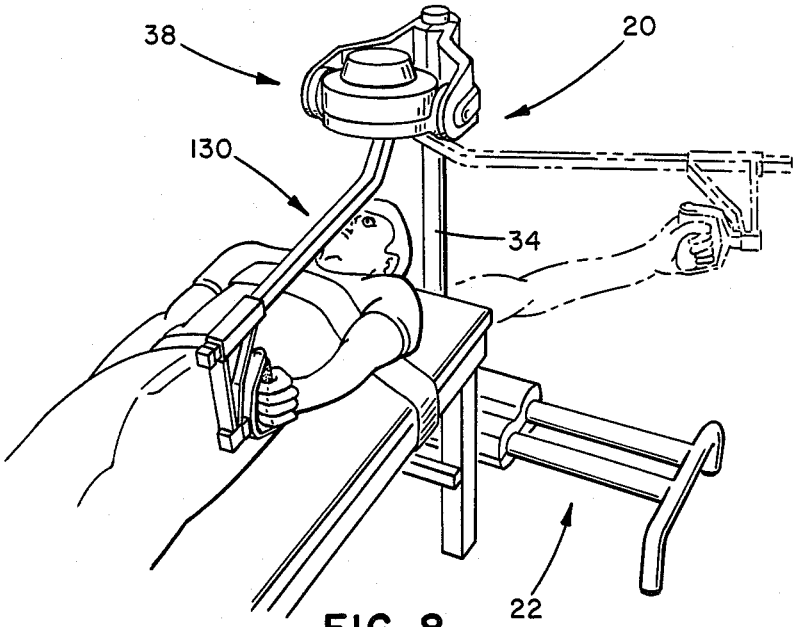
FIG. 8 is a perspective view of the exercise machine of FIG. 1 being used for shoulder abduction and adduction exercise.

Specific exercises are shown in FIGS. 8–14 as follows:

FIG. 8 illustrates shoulder abduction/adduction exercise. For this exercise, exercise arm 130 is used and brake 91 is adjusted so that brake shaft 84 is pointing vertically downward and aligned with the shoulder.

Figure 9:
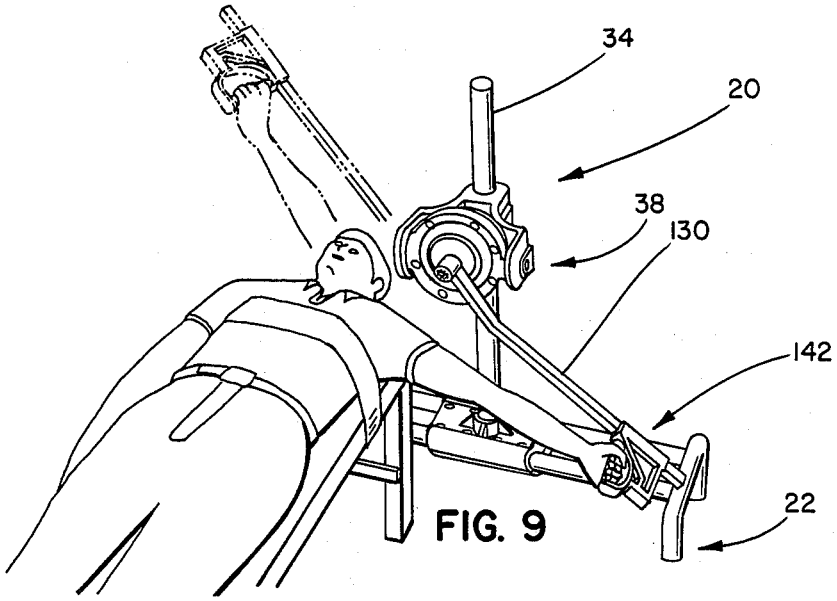
FIG. 9 is a perspective view of the exercise machine of FIG. 1 being used for horizontal shoulder abduction and adduction exercise.

FIG. 9 illustrates horizontal shoulder abduction and adduction. In this case, machine 20 is adjusted to that brake shaft 84 is horizontal and is aligned with the exercising individual's shoulder.

Figure 10:
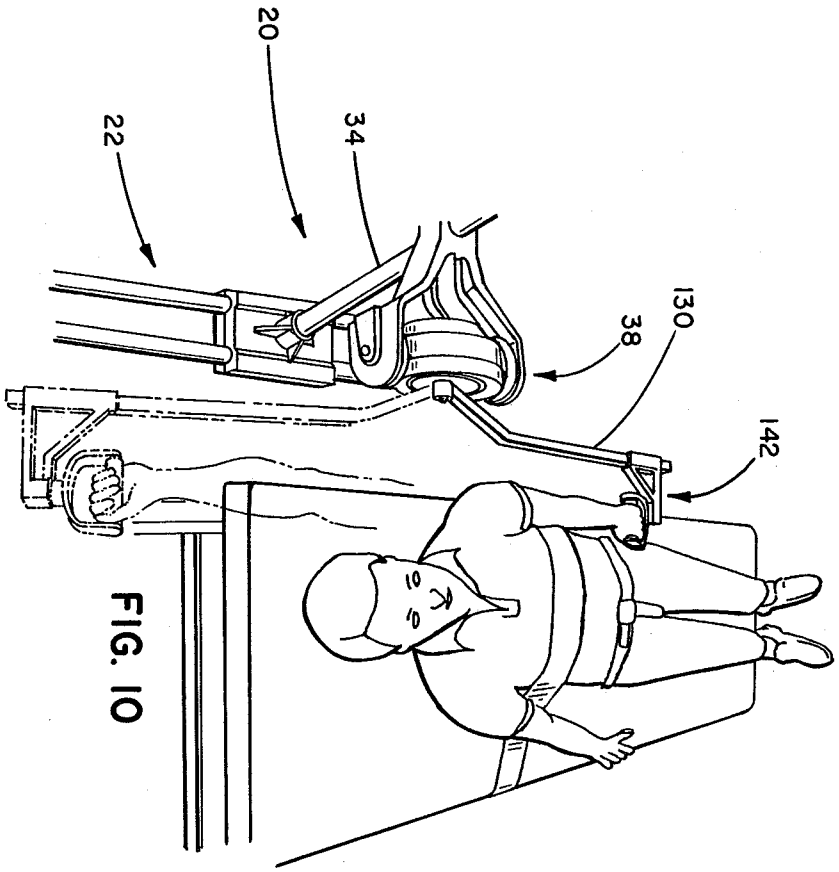
FIG. 10 shows the machine of FIG. 1 being used for shoulder extension and flexion exercise.

FIG. 10 illustrates use of exercise arm 130 for shoulder extension/flexion exercising.

Figure 11:
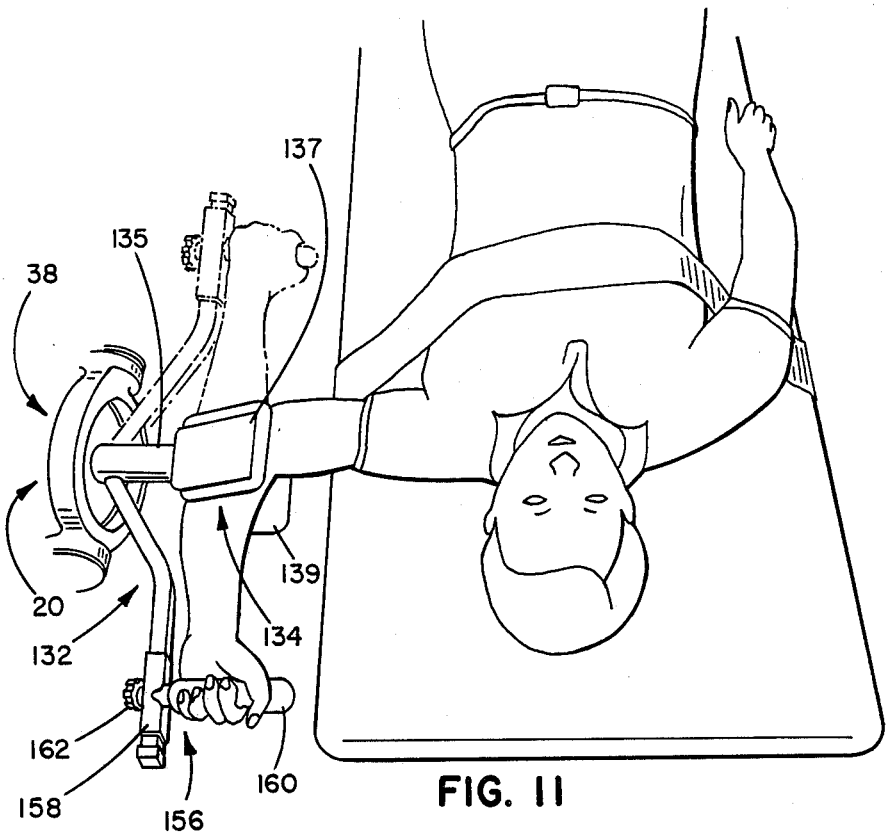
FIG. 11 shows the exercise machine of FIG. 1 provided with a shorter exercise arm being used for shoulder internal and external rotation with 90° abduction exercise.
Figure 12:
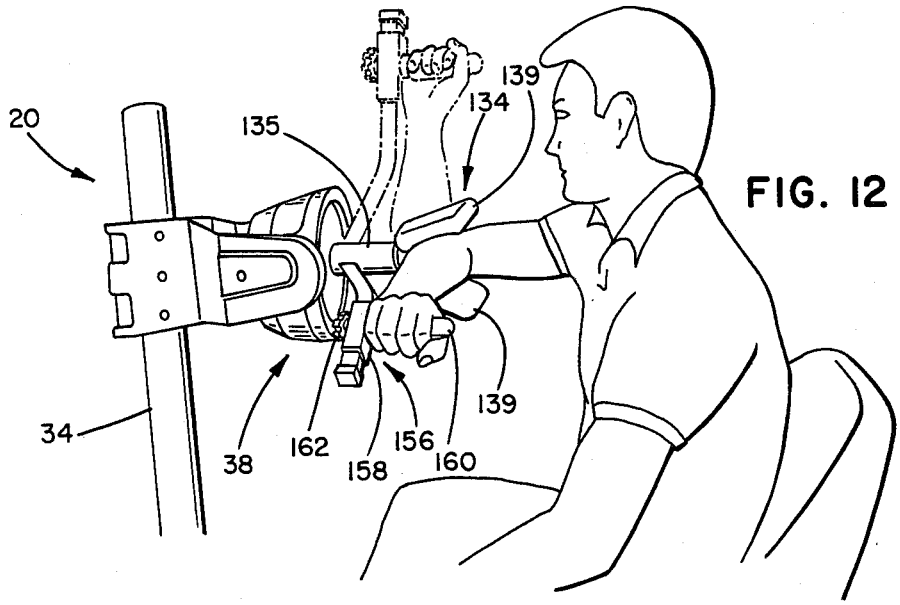
FIG. 12 illustrates the exercise machine of FIG. 1 outfitted as shown in FIG. 11 and being used for shoulder internal and external rotation with 90° flexion exercise.
Figure 13:
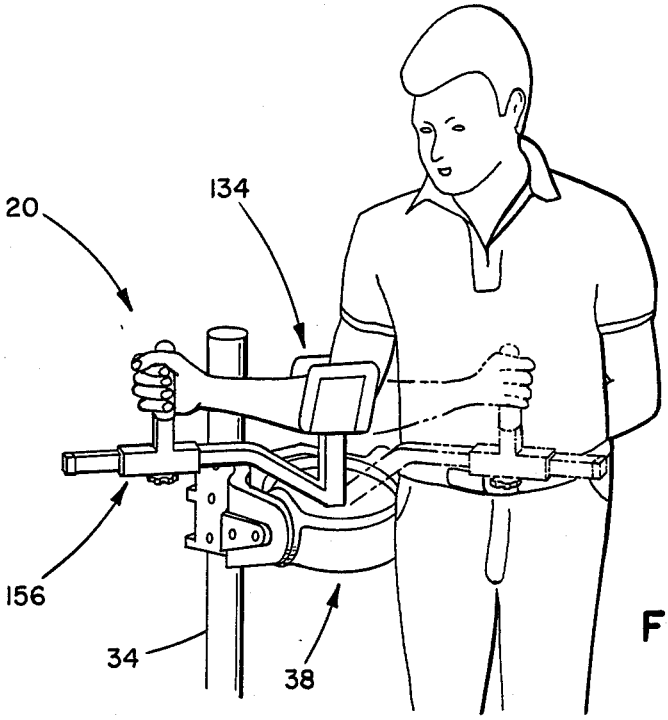
FIG. 13 shows the exercise machine of FIG. 1 being used to exercise the shoulder in neutral position, internal and external rotation.

FIGS. 11–13 show use of exercise arm 132 and elbow stabilizer 134 to provide various shoulder rotation exercises as well known to those skilled in the art.

Figure 14:
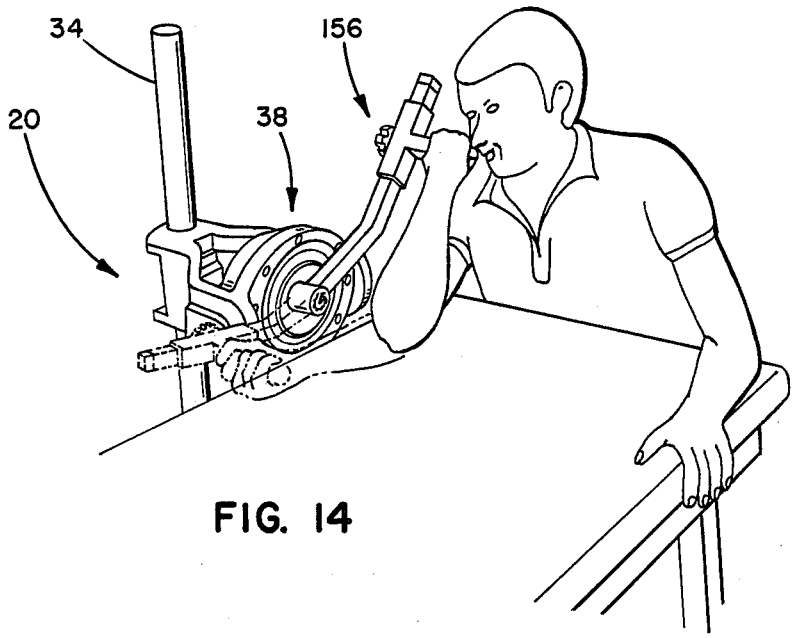
FIG. 14 illustrates the exercise machine of FIG. 1 with an elbow exercise attachment, being used for elbow extension and flexion exercise.
Figure 15:
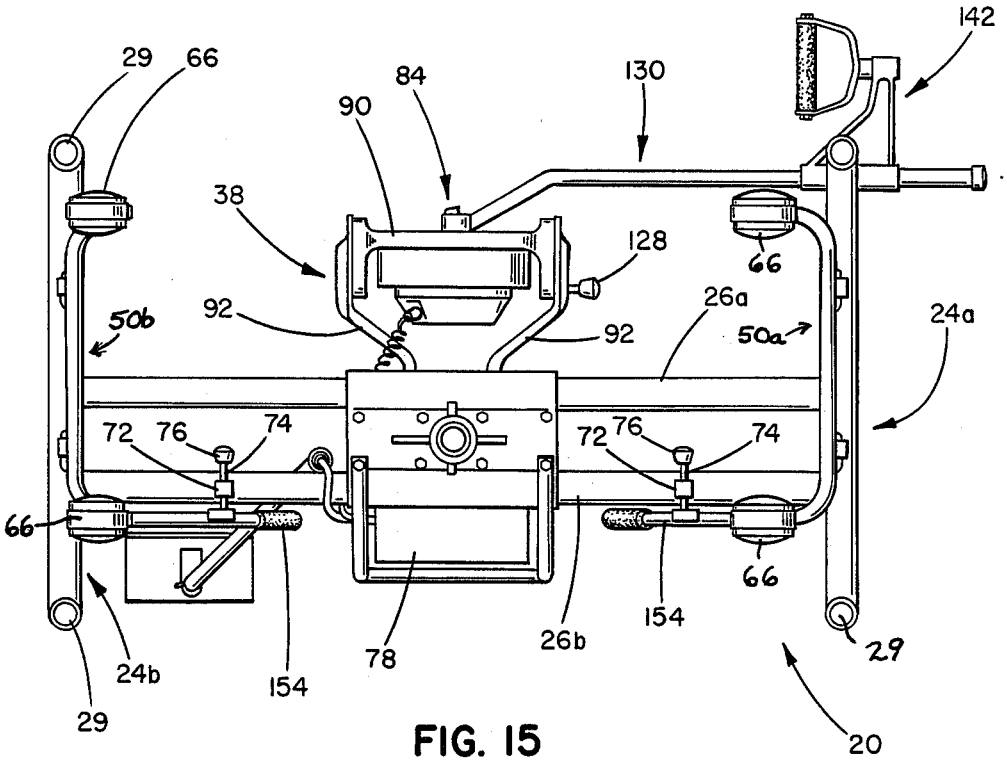
FIG. 15 is a bottom plan view of the exercise machine of FIG. 1.

Finally, FIG. 14 illustrates use of exercise arm 132 without elbow stabilizer 134 for elbow extension/flexion exercising.

FIGS. 8–14 clearly show why it is desirable to have a shoulder and elbow exercise machine which is portable and adjustable. This point becomes even more clear when the many possible obligue or diagonal exercises are considered.

A preferred embodiment of the invention is described above. Those skilled in the art will recognize that many embodiments are possible within the scope of the invention. Variations and modifications of the various parts and assemblies can certainly be made and still fall within the scope of the invention. Thus, the invention is limited only to the apparatus and method recited in the following claims, and equivalents thereto.

We claim:

1. An arm and shoulder exercise apparatus comprising:

(a) a base;

(b) a resistance unit operatively connected to the base;

(c) an exercise arm extending from the resistance unit; and (d) a hand grip assembly slideably mounted on the exercise arm, comprising:

(i) a hand grip suitable for grasping;

(ii) a hand grip support for supporting the hand grip forming an exercise arm aperture suitable for receiving the exercise arm; and (iii) a plurality of spaced elongate plastic slides separating the hand grip support from the exercise arm, wherein the exercise arm has a square cross section, the exercise arm aperture is square, and the slides are L-shaped and located at the four corners of the exercise arm and exercise arm aperture, wherein each of the slides includes enlarged ends which bear on the outer edges of the hand grip support, whereby the individual nature of the slides permits easy insertin of the slides into the exercise arm aperture prior to mounting the hand grip assembly on the exercise arm, and whereby the slides provide a low friction interconnection between the hand grip assembly and the exercise arm.

2. The exercise apparatus of claim 1, wherein the slides are polyethylene.

3. The exercise apparatus of claim 1, wherein the portion of the hand grip support which forms the exercise arm aperture is about 6 inches long, whereby binding of the hand grip assembly on the exercise arm is substantially precluded.

4. An arm and shoulder exercise apparatus comprising:

(a) a base comprising four depending feet;

(b) a pair of caster assemblies operatively connected to the base, each caster assembly comprising:

(i) a lift frame pivotally connected to the base; and (ii) a pair of casters pivotally connected to the lift frame, each lift frame having a raised position wherein the associated pair of casters is above the associated pair of feet and a lowered position wherein the associated pair of casters is below the associated pair of feet;

(c) a rack extending vertically upward from the base;

(d) an electromagnetic brake unit suitable for providing controlled exercise resistance;

(e) a pair of yokes which extend from the rack and pivotally support the electromagnetic brake, wherein the yokes can be vertically adjusted along the rack, wherein a wide variety of orthogonal and oblique exercises can be accommodated;

(f) a friction pin received by one of the yokes suitable for frictional engagement with the rack, whereby the yokes and the electromagnetic brake unit can be frictionally secured to the rack in their selected vertical position;

(g) a pair of spring-loaded pins operatively supported by the base suitable for selectively locking the lift frames in their lowered positions, whereby when the lift frames are locked in their lowered positions the exercise apparatus is mobile, and when the lift frames are in their raised positions the exercise apparatus is supported by the feet and is stationary;

(h) an exercise arm extending from the brake unit;

(i) a hand grip assembly slideably mounted on the far end of the exercise arm, comprising:

(1) a hand grip suitable for grasping;

(2) a hand grip support suitable for supporting the hand grip forming an exercise arm aperture suitable for receiving the exercise arm; and (3) a plurality of spaced elongated plastic slides separating the hand grip support from the exercise arm, wherein the exercise arm has a square cross section, the exercise arm aperture is square, and the slides are L-shaped and located at the four corners of the exercise arm and exercise arm aperture, wherein each of the slides includes enlarged ends which bear on the outer edges of the hand grip support, whereby the individual nature of the slides permits easy insertion of the slides into the exercise arm aperture prior to mounting the hand grip assembly on the exercise arm, and whereby the slides provide a low friction interconnection between the hand grip assembly and the exercise arm, (j) a removable elbow support extending from the resistance unit proximate the near end of the exercise arm, whereby relative motion between an individual's elbow and shoulder can be substantially eliminated; and (k) means for providing audible stops at adjustable exercise arm limits of motion.

* * * * *